US009162256B2

(12) United States Patent
Baetz et al.

(10) Patent No.: US 9,162,256 B2
(45) Date of Patent: Oct. 20, 2015

(54) METHOD FOR CLASSIFYING A GROUND MATERIAL-FLUID MIXTURE AND MILL CLASSIFIER

(71) Applicant: LOESCHE GMBH, Duesseldorf (DE)

(72) Inventors: André Baetz, Juechen (DE); Michael Keyssner, Duesseldorf (DE)

(73) Assignee: LOESCHE GmbH, Duesseldorf (DE)

( * ) Notice: Subject to any disclaimer, the term of this patent is extended or adjusted under 35 U.S.C. 154(b) by 222 days.

(21) Appl. No.: 13/902,712

(22) Filed: May 24, 2013

(65) Prior Publication Data

US 2013/0284644 A1 Oct. 31, 2013

Related U.S. Application Data

(62) Division of application No. 13/058,506, filed as application No. PCT/EP2009/005039 on Jul. 10, 2009, now Pat. No. 8,453,846.

(30) Foreign Application Priority Data

Aug. 12, 2008 (DE) ..... 10 2008 038 776

(51) Int. Cl.
*B07B 7/08* (2006.01)
*B07B 7/083* (2006.01)
*B04C 5/12* (2006.01)

(52) U.S. Cl.
CPC .. *B07B 7/083* (2013.01); *B04C 5/12* (2013.01)

(58) Field of Classification Search
CPC ..... B07B 7/04; B07B 7/08; B07B 7/083; B04C 5/12; B04C 5/13; B04C 2005/136; B02C 23/08; B02C 23/10
USPC ..... 209/138, 139.1, 142, 143, 154, 713, 209/714, 715, 718, 720; 95/270; 55/400; 241/79, 80
See application file for complete search history.

(56) References Cited

U.S. PATENT DOCUMENTS 1,146,633 A 7/1915 Lyons
1,814,395 A 7/1931 Lykken
(Continued)

FOREIGN PATENT DOCUMENTS

CN 2494713 Y 6/2002
CN 2753472 Y 1/2006
(Continued)

OTHER PUBLICATIONS

"Sepax Sichter" of Fa.F.L.Smidth,1991.
(Continued)

*Primary Examiner* — Joseph C Rodriguez
(74) *Attorney, Agent, or Firm* — Studebaker & Brackett PC

(57) ABSTRACT

In order to improve the grinding and classification process, the subsequent dust separation, and to optimize the energy situation of a grinding plant, with the aid of a guiding apparatus and a displacement body, the fine material-fluid low leaving the dynamic classifier part with angular momentum, besides a swirl reduction or swirl elimination, is made uniform in a classifier outlet housing and deflected into a virtually linear flow. The fixed guiding apparatus arranged coaxially with the classifier axis in the classifier outlet housing and the displacement body can be formed as one unit and the guide elements of the guiding apparatus can be arranged on the displacement body and extending into the vicinity of the inner wall of the classifier outlet housing.

5 Claims, 3 Drawing Sheets

(56) References Cited

U.S. PATENT DOCUMENTS

Figure 1:
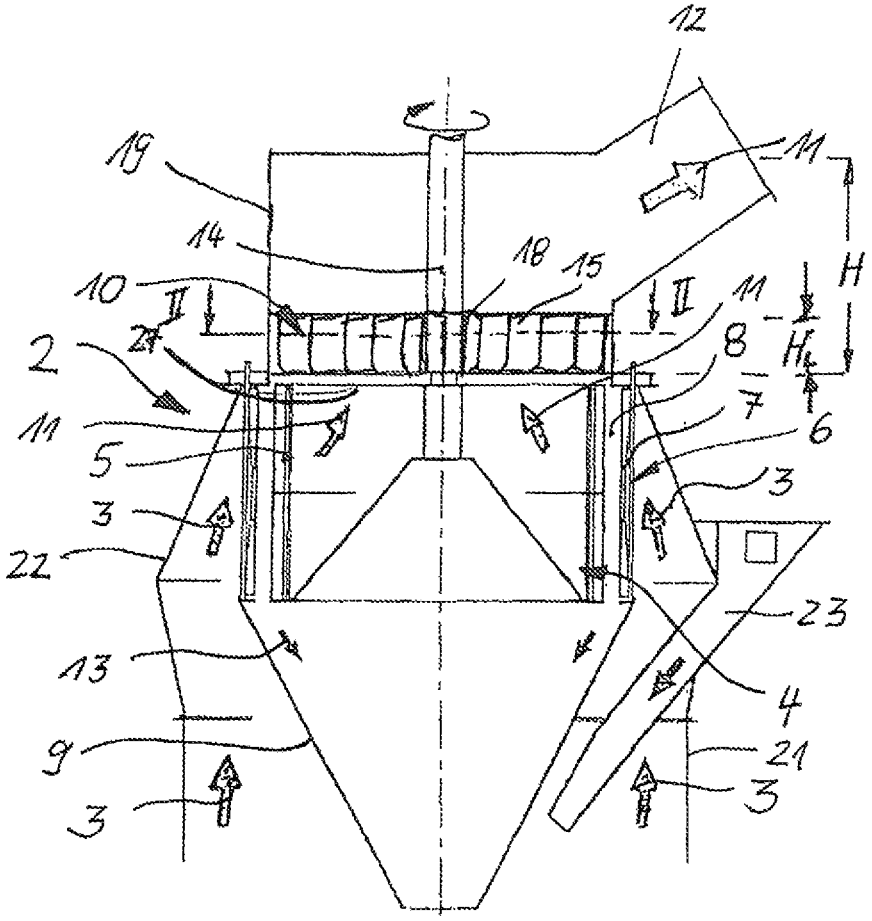

| | | | | |
|---|---|---|---|---|
| 3,770,124 | A | 11/1973 | Frangquist | |
| 4,296,864 | A | 10/1981 | Misaka et al. | |
| 4,390,419 | A | 6/1983 | Barthelmess | |
| 4,597,537 | A | 7/1986 | Misaka et al. | |
| 4,626,343 | A | 12/1986 | Folsberg | |
| 4,636,302 | A | 1/1987 | Folsbeg | |
| 4,689,140 | A | 8/1987 | Folsberg | |
| 4,689,141 | A | 8/1987 | Folsberg | |
| 4,848,993 | A | 7/1989 | Elkjaer | |
| 5,005,770 | A | 4/1991 | Suessegger | |
| 5,115,989 | A | 5/1992 | Poeschl | |
| 5,120,431 | A | 6/1992 | Cordonnier | |
| 5,392,998 | A | 2/1995 | Suessegger et al. | |
| 5,511,668 | A | 4/1996 | Keuschnigg | |
| 5,533,629 | A | 7/1996 | Ito et al. | |
| 5,622,321 | A | 4/1997 | Brundiek et al. | |
| 6,318,559 | B2 | 11/2001 | Cordonnier et al. | |
| 6,588,598 | B2 | 7/2003 | Wark | |
| 6,827,221 | B1 | 12/2004 | Brundiek et al. | |
| 7,156,235 | B2 | 1/2007 | Eisinger | |
| 7,416,575 | B2 | 8/2008 | Oh et al. | |
| 7,900,779 | B2 * | 3/2011 | Kolacz | 209/714 |
| 7,913,851 | B2 | 3/2011 | Chang | |
| 8,312,994 | B2 * | 11/2012 | Schneider et al. | 209/139.1 |
| 8,353,408 | B2 * | 1/2013 | Ito | 209/713 |
| 8,453,846 | B2 * | 6/2013 | Baetz et al. | 209/721 |
| 8,915,373 | B2 * | 12/2014 | Lin et al. | 209/140 |
| 2009/0178960 | A1 | 7/2009 | Chang | |

FOREIGN PATENT DOCUMENTS

| | | | |
|---|---|---|---|
| DE | 1507817 | A | 1/1970 |
| DE | 2556382 | A | 6/1977 |
| DE | 4005031 | C1 | 8/1991 |
| DE | 19943528 | A1 | 3/2001 |
| DE | 102005008475 | A1 | 3/2006 |
| EP | 0164859 | B1 | 12/1987 |
| EP | 0171987 | B1 | 10/1989 |
| EP | 0210729 | B1 | 1/1990 |
| EP | 0369594 | A1 | 5/1990 |
| EP | 0204412 | B1 | 7/1990 |
| EP | 0284184 | B1 | 6/1991 |
| EP | 0645196 | A1 | 3/1995 |
| EP | 0691159 | A1 | 1/1996 |
| JP | H07-195037 | A | 8/1995 |
| JP | H08-052433 | A | 2/1996 |
| JP | 2003-517927 | A | 6/2003 |
| UA | 11094 | C | 12/1996 |
| UA | 30376 | A | 11/2000 |
| UA | 63054 | A | 1/2004 |
| UA | 70543 | A | 10/2004 |

OTHER PUBLICATIONS

E. Militzer; "International Search Report"; PCT/EP2009/005039; Feb. 10, 2010.

* cited by examiner

METHOD FOR CLASSIFYING A GROUND MATERIAL-FLUID MIXTURE AND MILL CLASSIFIER

The invention relates to a method for classifying a ground material-fluid mixture and a mill classifier for carrying out the method.

The invention is particularly suited for roller mill classifiers which can be integrated into or placed on a vertical roller bowl mill or a roller grinding mill, for example an air-swept roller mill.

The classifiers generally have a dynamic classifier part, for example a strip or bladed rotor and static guide vanes which are arranged in a ring around the dynamic classifier part, whereby a classifying chamber or area is formed. The ground material-fluid mixture reaches the classifying chamber in an upwardly orientated spiral flow close to the housing, in which classifying chamber the coarse particles are separated and fall via a grit cone back into the grinding chamber for renewed grinding. The fine material reaching the strip rotor is fed in a fine material-fluid flow to the classifier upper part and via a fine material discharge and a pipe to a fine material separation (EP 1 239 966 B1, DE 44 23 815 C2, EP 1 153 661 B1, DE 36 17 746 A1, DE 34 03 940 C2).

A classifier integrated into a vertical air-swept roller mill is known from U.S. Pat. No. 4,597,537, in which additional carrier or classifying gas is additionally fed via fluid feeds arranged tangentially in relation to the classifying chamber, whereby the classifying effect is intended to be improved.

Wind classifiers are described in DE 44 29 473 C2 having a device for influencing the flow pattern which is arranged in an air outflow chamber. The air outflow chamber is surrounded by a classifying wheel and its vanes and a classifying chamber is formed around the classifying wheel, to which the ground material to be classified is fed together with or separate from the classifying air. The device for influencing the flow pattern in the classifier consists of guide vanes which exhibit a curvature in radial direction and are arranged along the radial outer delimitation of the air outflow chamber. The air outflow chamber goes into a coaxially formed fine material-air outlet and the arched guide vanes arranged around the edge in the air outflow chamber are fixed to the inner side of the air outlet. During classification coarse particles are separated from fine particles in the classifying chamber and fall into a coarse particle discharge. The fine material-air flow passes between the vanes of the classifying wheel into the region of the adjacent guide vanes and is deflected from a radial into an axial flow and discharged via the fine material-air outlet. It is thereby intended to largely avoid swirl formation through the curved guide vanes and lower flow resistances are to be achieved.

The arrangement of the device for influencing flow within the classifier rotor and close to the vanes of the classifier rotor can have a negative effect upon the classification in the classifying chamber and lead to a reduced quality of the classification. In addition subsequent incorporation of the device or exchange thereof requires relatively great resources.

In a method known from DE 40 25 458 C2 and a device for spiral wind classification of particles with separation boundaries below 20 μm using a rotor the fine material aero-dispersion is drawn off in the flow direction directly behind the rotor vanes into an annular suction channel or into a suction pipe below the rotor. By means of a guide vane apparatus or a diffuser which is arranged in the annular suction channel or in the suction pipe, after the suction at least a part of the swirl still present in the drawn-off fine material aero-dispersion is to be removed from the flow. The interactions between the suction channel or suction pipe and the arrangement and/or dimensions of the rotor vanes can have a disadvantageous effect upon the throughput, separation intensity and separation boundaries.

A wind classifier is described in DE 199 47 862 A1 with a classifying wheel rotating in a classifying chamber. The classifying wheel is provided with a cover plate and the fine material-air flow passes via an axial discharge opening in the cover plate of the classifying wheel into an expansion housing which is formed as a spiral housing and is provided with a side outlet channel. Fan blades extending into the expansion vessel are arranged on the cover plate rotating with the classifying wheel, said fan blades being intended to supply additional kinetic energy in the expansion vessel to the fine material-air flow.

Grinding plants, in particular for dusts, consume considerable amounts of energy. Energy saving is a constant requirement having regard to economic and ecological perspectives. Air-swept roller grinding plants have been continuously optimised in the past in order to reduce the energy consumption, whereby essentially the reduction in the differential pressure of the mill and a reduction in the quantities of gas are at the forefront here.

The classification process has a great influence upon the efficiency of a grinding plant. For example the classification process influences the smooth running of the mill, the throughput of finished material and pressure loss of the whole system. The differential pressure for overcoming the flow resistances in the classifier and the power consumption on the rotor account for a considerable part of the energy use of the whole grinding plant.

It is an object of the invention to create a classification method and a mill classifier which increase the quality of the classification process and simultaneously lead to an improvement in the energy situation and lower investment requirements for the whole grinding plant.

The object of the invention in terms of the method is achieved through the features of claim 1 and in relation to a mill classifier through the features of claim 6. Useful and advantageous embodiments of the invention are contained in the subordinate claims and in the description of the drawings.

A fundamental idea of the invention can be seen in that the fine material-fluid flow which leaves the dynamic classifier part on account of the rotation of the rotor in a rotation movement or in a swirl is to be made uniform and a swirl dissolution or elimination or at least a considerable reduction of the swirl is to be achieved.

The characteristics of the swirl are dependent upon the peripheral speed of the rotor which is in turn orientated towards the particle size to be classified. Finer classifications require a higher peripheral speed than coarser classifications.

The fine material-fluid flow leaving the dynamic classifier part with angular momentum is disadvantageous having regard to various aspects. The fine material or the dust of the two-phase flow is for example pressed against the wall of the classifier upper part on account of the centrifugal force generated by the swirl, whereby due to the friction flow losses and wear arise on the wall of the classifier upper part. In addition it has been ascertained that so-called "dust strands" form which in relation to the fine material-fluid flow lead to an irregular distribution of the fine material particles in the classifier and also in the subsequent dust separator. Cyclones and/or filters, for example a bag filter, can be provided as dust separators. In the classification process and classifiers without, or with only inadequate, swirl elimination over-dimensioning of the dust separators has been used in many cases.

In the classification method according to the invention the swirl of the two-phase flow leaving the dynamic classifier part is eliminated or at least considerably reduced and is conveyed in the form of a virtually linear flow from the classifier into the subsequent separation unit. Through the elimination of the swirl a disadvantageous storage of flow energy is avoided and a considerable saving in differential pressure or energy consumption is achieved.

The uniformisation of the fine material-fluid flow according to the invention after leaving the dynamic classifier part thus comprises a reduction or elimination of the angular momentum of the fine material-fluid flow leaving the rotor directly above the outlet cross-section of the dynamic classifier part and the formation of a linear flow as far as the outlet opening of the classifier and as far as the subsequent units.

At the same time the uniformisation of the fine material-fluid flow comprises a deflection of a spirally rising flow into a virtually vertical flow with the aid of a guiding apparatus which is arranged in a classifier outlet housing above the outlet cross-section of the dynamic classifier part.

According to the invention it is also provided that the fine material-fluid flow is subjected to a displacement body in addition to the guiding apparatus. This displacement body is usefully constructed and arranged in such a way that the disadvantages of a pressure drop forming on account of the rotation of the dynamic classifier part are largely avoided. The pressure drop or potential swirl depression stores the flow energy in the form of angular momentum. At the same time a part of the fine material-fluid flow is moved into the rotor inner space, whereby a backflow into the rotor centre takes place and the ground material particles fall onto the bottom of the rotor. Insofar as the displacement body is formed and arranged in such a way that the pressure drop is covered and cannot therefore developed its effect, a further uniformisation and an efficient fine material-fluid discharge is achieved without backflow into the dynamic classifier part.

A mill classifier according to the invention which is provided with a guide vane ring and a dynamic classifier part, thereby forming a classification chamber or area, and with a coarse material removal and at least one discharge opening for a fine material-fluid flow comprises a device for uniformisation and swirl elimination or dissolution downstream after the dynamic classifier part in a classifier outlet housing.

The mill classifier according to the invention is preferably a classifier integrated or placed on an air-swept roller mill, with a strip or bladed rotor as the dynamic classifier part and with a grit cone for removing the coarse material particles from the classification chamber and returning them to the grinding chamber for a renewed reduction or grinding process. According to the invention a guiding apparatus with guide elements which influences the fine material-fluid flow in a flow-enhancing way is provided as the device for uniformisation and swirl elimination of the fine material-fluid flow leaving the dynamic classifier part.

In addition a displacement body is arranged according to the invention in particular co-axially with the classifier or rotor axis.

It is advantageous if the device for uniformisation and swirl elimination of the fine material-fluid flow leaving the dynamic classifier part is of fixed construction and in addition the guiding apparatus forms a unit with the displacement body.

The guiding apparatus is arranged according to the invention above an outlet cross-section of the dynamic classifier part in the classifier outlet housing. The displacement body usefully extends beyond the guiding apparatus and can for example be of a height which amounts to two to five times the height of the guiding apparatus.

The displacement body can advantageously project with a lower, for example conical region, into the dynamic classifier part and prevent the formation of a pressure drop. If the dynamic classifier part is a strip or bladed rotor with an upwardly orientated rotor cone the lower conical region of the displacement body can extend as far as the vicinity of this rotor cone. In a preferred embodiment the displacement body is formed as a double cone, in which the upper conical or truncated cone shaped region exhibits a lower conicity than the lower conical or truncated cone shaped region.

Particularly with smaller mill classifiers the displacement body can also be formed in a simplifying manner in the axial section essentially cylindrically.

In dependence upon the specification of the mill classifier a displacement body rotating with the rotor can also be provided.

In relation to the diameter of a classifier outlet housing in which the guiding apparatus and the displacement body are received, the diameter $D_2$ at the upper end of the displacement body can lie in a ratio to the diameter of the classifier outlet housing or inner diameter $D_R$ of the rotor in the region of 0.35 to 0.6.

In principle the guiding apparatus can have the most varied formation in order to collect the fine material-fluid flow leaving the dynamic classifier part with angular momentum and to deflect it into an essentially vertical linear flow.

The guiding apparatus can comprise planar or plate-form guide elements which are radially arranged. For example the guide elements can be formed as metal plates and be fixed to a guide tube which is usefully arranged coaxially with the rotor axis. It is appropriate for swirl elimination and deflection of the rotating fine material-fluid flow to design the guide elements with an incident flow region which is formed for an incident flowing of the fine material-fluid mixture in a lower region close to the rotor with a curvature against the swirl direction.

The guide elements can also be formed in the manner of an arc and/or blade or spherically in order to collect the fine material-fluid flow in a flow-enhancing way and to deflect it in a sliding or smooth way into a vertical flow direction.

In the preferred embodiment of the device for uniformisation and swirl reduction or elimination with a guiding apparatus and a displacement body it is particularly advantageous that the guide elements can be fixed with their flow straightening surfaces on the outer periphery of the displacement body. This usefully occurs in a lower region of the upper conical or truncated cone shaped region of the displacement body so that a larger region extends upwardly over the guide elements and contributes to the uniformisation and linear flow of the fine material-fluid mixture.

Insofar as the swirl is eliminated or the angular momentum is considerably reduced the formation of turbulence is reduced and the mixing of the fine material particles or the dust particles with the fluid, for example air, is effectively supported.

It is useful to provide a classifier outlet housing which facilitates a further vertical upward flow of the homogenized linear fine material-fluid mixture between the displacement body and the classifier housing. For example the classifier outlet housing can be formed for integrated arrangement of the guiding apparatus and advantageously of the displacement body and have an overall height H which is two to four times greater than the height $H_L$ of the guiding apparatus. The classifier outlet housing is usefully cylindrically or conically formed and comprises in an upper and/or lateral region at least one outlet opening for the deflected, linear fine material fluid flow. An outlet nozzle for the fine material-fluid flow flowing in the direction of the dust separator can be arranged in particular in a laterally inclined way or horizontally.

It is advantageous if the displacement body, in case of a lateral arrangement of the outlet nozzle, reaches over the lower edge of the outlet nozzle.

The advantages of the classification method according to the invention and the mill classifier according to the invention comprise a virtually swirl-free, well-mixed fine material-fluid mixture or dust-air flow with a regular dust distribution at the classifier outlet and hence also at the inlet cross-section of the subsequent dust separator. Insofar as a backflow of a proportion of the fine material-fluid flow into the rotor centre is avoided with the aid of the displacement body of the device according to the invention, as the pressure drop forming is virtually covered, falling of grinding material particles onto the rotor bottom is prevented and the efficiency of the classification process is increased.

The more uniform dust distribution results in a lower air requirement for the pneumatic transport of the dust or the fine material particles, associated with lower wear on the walls of the classifier housing. The swirl elimination or dissolution according to the invention reduces the pressure loss in the classifier and thus also the power consumption of the classifier drive. At the same time there is an improved incident flow of the subsequent dust separator, for example a filter, and thus over-dimensioning of this dust separator is avoided. The classifier outlet housing can also have a simple construction. Essential features are the energy recycling and reduction as well as a considerably improved degree of efficiency in the subsequent dust separation as a result of a more uniform distribution of the dust across individual filter chambers (modules) and more regular distribution across separation cyclones. Besides an improvement in the classification process and hence also in the milling process, a considerable increase in efficiency is thus achieved in the operation of a grinding plant.

The method according to the invention is preferably suitable for air-swept roller mills with an integrated classifier but not limited thereto. The device for swirl elimination or swirl reduction can be used in principle with all classifiers having a dynamic rotating classifier part. It is advantageous that the arrangement of the device for swirl elimination according to the invention having a guiding apparatus and a displacement body can be pre-manufactured and in addition can be subsequently incorporated into or placed on a classifier.

Figure 2:
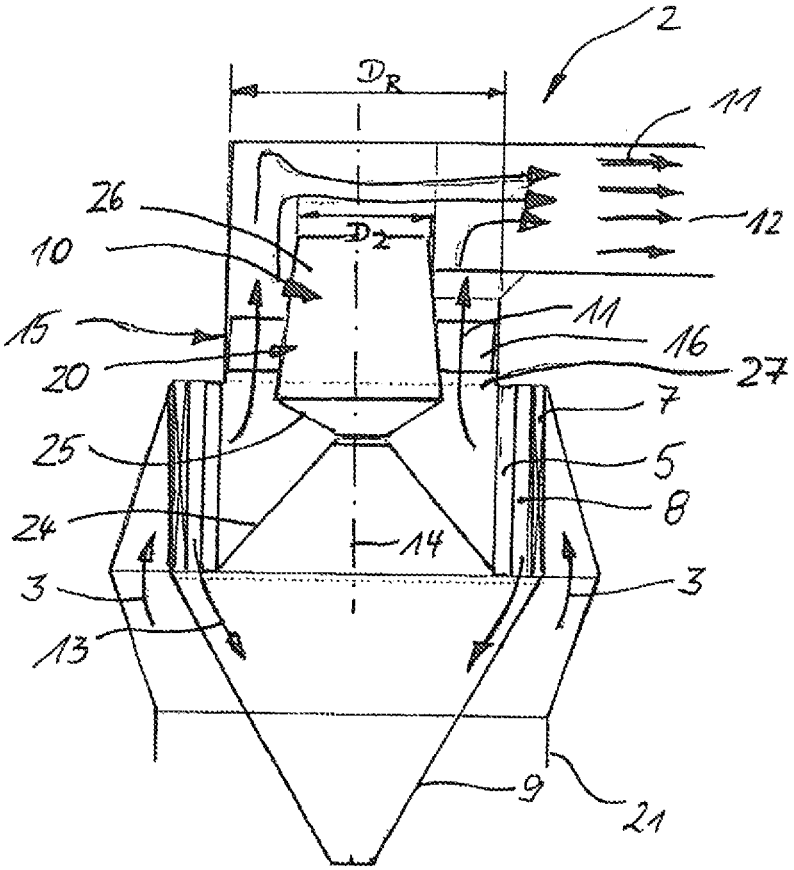
Figure 3:
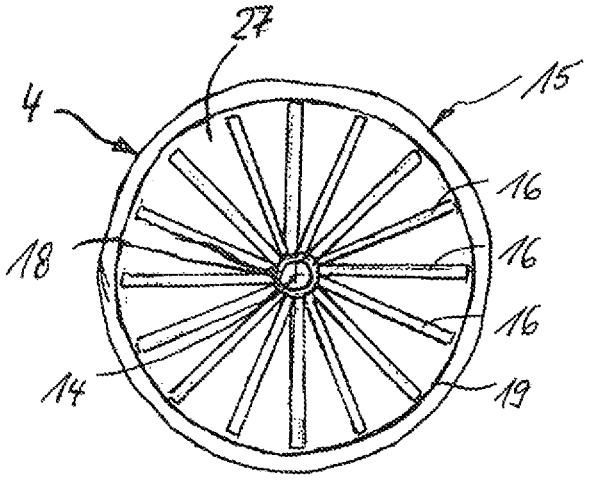

The invention is described in greater detail below by reference to the drawing, in which the following are shown in a highly schematised illustration:

FIG. 1 a mill classifier with a guiding apparatus;

FIG. 2 a mill classifier according to the invention with a guiding apparatus and a displacement body;

FIG. 3 a horizontal section along the line II-II in FIG. 1 and

Figure 4:
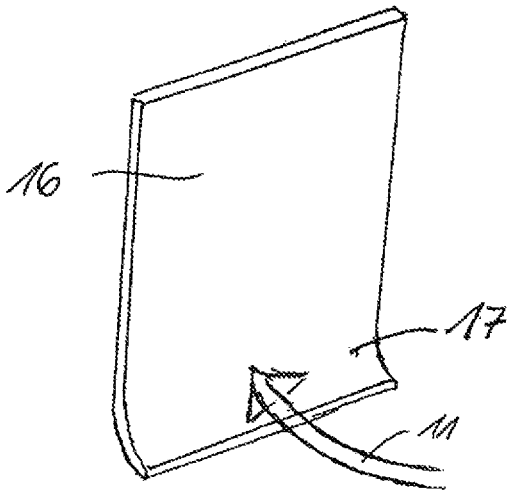

FIG. 4 a perspective illustration of a guiding element of a guiding apparatus of the mill classifier according to the invention.

FIG. 1 shows a mill classifier 2 which is integrated into a roller mill. Only an upper region of the mill housing 21 of the roller mill is shown with a lateral grinding material supply 23. The classifier housing 22 connects to the grinding material housing 21.

The mill classifier 2 comprises a dynamic classifier part 4 which in this embodiment is a strip or bladed rotor with rotor blades 5 arranged concentrically around a rotor axis 14. Provided coaxially with the dynamic classifier part 4 is a guide vane ring 6 with guide vanes 7 which are arranged so as to be stationary and possibly adjustable. A ground material-fluid mixture 3 rising from the grinding chamber passes in a rotation flow from the grinding chamber into the classifying chamber 8, in which the coarse material particles 13 are separated and fed via a grit cone 9 as coarse material discharge for renewed comminution.

A fine material-fluid flow 11 which is also described as a dust-air mixture passes via an outlet cross-section 27 of the dynamic classifier part 4 into a classifier outlet housing 19 which has a height H and extends upwardly from the outlet cross-section 27 of the dynamic classifier part 4.

Disposed in a lower area of the classifier outlet housing 19 connected virtually directly to the dynamic classifier part 4 is a device 10 for uniformisation and swirl elimination of the fine material-fluid flow 11 leaving the dynamic classifier part 4 with an angular momentum.

FIG. 1 shows that the height $H_L$ of the device 10 in this embodiment amounts to around a third of the overall height H of the classifier outlet housing 19.

The device 10 for uniformisation and swirl elimination or dissolution of the fine material-fluid flow 11 leaving the dynamic classifier part 4 with angular momentum is formed as a fixed, stationary guiding apparatus 15 which is provided with guide elements 16 arranged and formed in a defined way.

In the present embodiment the guide elements 16 for the rotating, rising fine material-fluid flow 11 are arranged essentially vertically and in a radiant form and are fixed to a guide tube 18 of the guiding apparatus 15. The guide tube 18 of the guiding apparatus 15 is thereby formed to be circularly cylindrical and arranged coaxially with the rotor axis 14.

FIG. 3 shows the jet-form arrangement of the guide elements 16 on the guide tube 18 of the guiding apparatus 15. At the same time FIG. 3 illustrates that the guide elements 16 extend radially from the guide tube 18 and the guiding apparatus 15 extends virtually over the whole outlet cross-section 27 of the dynamic classifier part 4 and the virtually equally large inlet cross-section of the classifier outlet housing 19, whereby the guide tube 18 with a correspondingly larger diameter can already serve to cover the pressure drop formed in the dynamic classifier part 4.

The jet-form or radially orientated guide elements 16 of the guiding apparatus 15 cause a uniformisation and virtually linear orientation of the fine material-fluid flow 11 and a reduction in the angular momentum and elimination of the swirl.

The schematic representation of a guide element 16 in FIG. 4 shows the essentially planar or plate-like form and in a lower region which is close to the dynamic classifier part 4 in the incorporated state an incident flow region 17 which is formed with a curvature in the direction of the flowing fine material-fluid flow 11, that is to say contrary to the swirl direction, in order to collect and deflect the fine material-fluid flow 11 leaving the dynamic classifier part 4.

In the classifier 2 according to FIG. 1 a discharge opening 12 for the linear fine material-fluid flow 11 is arranged in an upper and lateral region of the classifier outlet housing 19 and orientated inclined upwardly. The fine material-fluid flow is fed with substantially more uniform distribution of the dust or fine material particles via a pipeline (not shown) for subsequent fine material separation (not shown).

FIG. 2 shows a preferred embodiment of a classifier 2 according to the invention, wherein the device 10 for uniformisation and swirl reduction or elimination comprises a displacement body 20 in addition to the guiding apparatus 15.

The components of the classifier 2 according to FIG. 2 which coincide with those of the classifier of FIG. 1 have identical reference numerals.

The displacement body 20 is arranged coaxially with the rotor axis 14 or mill axis and formed as a double cone in the vertical section, whereby a lower conical or truncated cone form region 25 extends into the dynamic classifier part 4 and as far as the vicinity of a rotor cone 24.

An upper conical or truncated cone shaped region 26 is considerably higher than the lower conical region 25 but formed with a lower conicity and its height is around two to five times the height of the guiding apparatus. With regard to the classifier outlet housing 19 the displacement body 20 extends as far as over half the height of said classifier outlet housing 19 and over the lower edge of the outlet opening 12 for the linearly flowing fine material-fluid mixture 11 made uniform.

The displacement body 20 is arranged and formed such that a pressure drop which forms as a result of the rotation of the dynamic classifier part 4 which is a strip rotor in this embodiment does not take effect, so that there is no backflow of a fine material-fluid portion into the rotor centre.

The guide elements 16 of the guiding apparatus 15 are fixed in a lower region of the upper truncated cone form region 26 of the displacement body 20, whereby the formation and arrangement of the guide elements 16 with their flow straightening surfaces as shown in FIGS. 3 and 4 can be provided in the form of a jet and with an incident flow region 17 exhibiting a curvature.

The diameter $D_2$ at the upper end of the displacement body 20 according to the embodiment of FIG. 2 can lie in a ratio of 0.35 to 0.6 in relation to the diameter $D_R$ of the guiding apparatus 15 which extensively coincides with the inner diameter of the classifier outlet housing 19 and the outlet cross-section 27 of the dynamic classifier part 4.

It is possible particularly with smaller classifiers for the displacement body to be formed approximately cylindrically in the vertical section.

In dependence upon the type of mill classifier the displacement body can also be formed rotating with the rotor about the rotation axis 14.

The invention claimed is:

1. Method for classifying a ground material-fluid mixture, produced in a roller grinding mill, comprising:

supplying the ground material-fluid mixture to a classifier having a dynamic classifier part with an outlet cross-section, separating coarse material from fine material in the dynamic classifier part, discharging the fine material in a fine material-fluid flow, wherein the fine material-fluid flow leaving the dynamic classifier part with an angular momentum is fed to a classifier outlet housing positioned above the outlet cross-section of the dynamic classifier part and wherein the fine material-fluid flow is made uniform and subjected to a swirl elimination and additionally exposed to a displacement body in the classifier outlet housing before the classifier outlet.

2. The method according to claim 1, wherein the fine material-fluid flow in the classifier outlet housing is fed to a guiding apparatus and the displacement body, deflected into a linear flow and after leaving the classifier is fed for a dust separation.

3. The method according to claim 2, wherein the fine material-fluid flow entering the classifier outlet housing is collected and deflected by guide plates of the guiding apparatus.

4. The method according to claim 3, wherein the deflected, virtually linear fine material-fluid flow is discharged via at least one outlet opening of the classifier outlet housing and subjected to the dust separation.

5. The method according to claim 2, wherein a pressure drop formed as a result of the rotation of the dynamic classifier part is covered by the displacement body.

* * * * *